US011564475B2

(12) United States Patent
Fearing

(10) Patent No.: US 11,564,475 B2
(45) Date of Patent: Jan. 31, 2023

(54) SHAVING-MIRROR APPARATUS

(71) Applicant: Daniel Fearing, Glendale, CA (US)

(72) Inventor: Daniel Fearing, Glendale, CA (US)

( * ) Notice: Subject to any disclaimer, the term of this patent is extended or adjusted under 35 U.S.C. 154(b) by 27 days.

(21) Appl. No.: 17/019,199

(22) Filed: Sep. 12, 2020

(65) Prior Publication Data

US 2022/0079323 A1 Mar. 17, 2022

(51) Int. Cl.
*A45D 42/16* (2006.01)
*A45D 42/08* (2006.01)

(52) U.S. Cl.
CPC ..... *A45D 42/16* (2013.01); *A45D 42/08* (2013.01)

(58) Field of Classification Search
CPC ..... A45D 42/16; A42D 42/08
USPC ..... 359/871
See application file for complete search history.

(56) References Cited

U.S. PATENT DOCUMENTS 858,079 A * 6/1907 Komorous
1,833,436 A * 11/1931 Priest ..... A45D 27/04 132/290
3,476,123 A * 11/1969 Flax ..... A45D 33/28 132/315
4,589,431 A * 5/1986 Yuhara ..... A45C 13/005 132/301
6,138,686 A * 10/2000 Yuhara ..... A45D 33/006 206/823
6,305,809 B1 * 10/2001 Zadro ..... G02B 5/10 359/872
6,325,077 B1 * 12/2001 Lark ..... A45C 11/008 132/316
2004/0112401 A1 * 6/2004 Riegel ..... A45D 27/28 132/291
2004/0188470 A1 * 9/2004 Hill ..... C03C 17/38 222/181.3
2004/0221866 A1 * 11/2004 Greenfield ..... A45D 40/222 132/287
2012/0024747 A1 * 2/2012 Germain ..... A45D 33/26 206/581
2015/0122755 A1 * 5/2015 McGee ..... A45D 27/29 248/346.11
2015/0314464 A1 * 11/2015 Guzak ..... B26B 21/40 30/526
2020/0337442 A1 * 10/2020 Fearing ..... A45D 42/08

* cited by examiner

*Primary Examiner* — Ricky D Shafer

(57) ABSTRACT

A shaving-mirror apparatus that is attachable to and readily removable from both the bottom of a shaving cream/gel container and the top of a shaving gel squeeze bottle, and a method of manufacturing the shaving mirror apparatus. The shaving mirror apparatus may comprise a flat mirror or a convex mirror, and the mirror may further comprise anti-fog and water repellant properties.

10 Claims, 23 Drawing Sheets

SHAVING-MIRROR APPARATUS

FIELD OF USE

The present disclosure relates generally to shaving mirrors. More specifically, the disclosure relates to a shaving-mirror apparatus that is attachable to and readily removable from both the bottom of a shaving cream/gel-can container and the top of a shaving-gel squeeze-bottle container.

BACKGROUND

The practice of shaving facial hair with shaving cream/gel and a razor is an almost daily occurrence for many individuals. Effective shaving requires a mirror. Generally, most individuals shave in front of a mirror above the bathroom sink—a time-consuming and somewhat cumbersome task because it requires individuals to rinse their face with water prior to shaving, continually rinse the razor in the sink throughout the shaving process, rinse/clean their face and razor after finishing, and then clean the area free of facial hair, water, and used shaving cream afterwards. Alternatively, shower mirrors currently in the market enable one to shave while in the shower, eliminating certain inefficiencies and the cumbersome nature of traditional shaving.

However, shower mirrors are awkward to use, unappealing, take up precious real estate in small showers, and are inconvenient to use. For example, existing support apparatuses of shower mirrors, such as suction cups or wire frames, are often in the way, poor quality at best, and ineffective at worst. They fail to attach to walls and rarely have universal application due to the wall material varying from bathroom to bathroom. Some are not very effective when the anti-fog treatment wears off and may pose safety risks if dropped. Many are made from plastic and are not durable or reliable. And none are conducive to being portable such that they're used both in and out of one's home. As a result, any benefits gained from the use of existing shower mirrors are outweighed by overall inconvenience.

Thus, what is needed is a new and improved shaving mirror that provides the benefits of a shower mirror without any of the existing common drawbacks or disadvantages. Ideally, such a shaving mirror is durable, portable for use in and out of one's residence, convenient to use in the shower, compatible with both cans and squeeze bottles, reusable, requires no additional space for placement, and comprises a fogless, safe, high-resolution mirror.

SUMMARY

The following presents a simplified overview of the example embodiments in order to provide a basic understanding of some embodiments of the example embodiments. This overview is not an extensive overview of the example embodiments. It is intended to neither identify key or critical elements of the example embodiments nor delineate the scope of the appended claims. Its sole purpose is to present some concepts of the example embodiments in a simplified form as a prelude to the more detailed description that is presented herein below. It is to be understood that both the following general description and the following detailed description are exemplary and explanatory only and are not restrictive.

In accordance with the embodiments disclosed herein, the present disclosure is directed to a shaving-mirror apparatus that is attachable to and readily removable from both (i) the bottom of a shaving cream/gel container via a slip-fit function and (ii) the top of a shaving-gel squeeze bottle via a slide-fit function, and a method of manufacturing the shaving-mirror apparatus. The shaving-mirror apparatus comprises a receptacle, wherein the receptacle comprises a bottom and an open top, wherein the bottom of the receptacle comprises a mirror. The shaving-mirror apparatus may further comprise a horizontal slit between the bottom and the open top of the receptacle.

In some embodiments, the mirror may comprise one of the following: a flat mirror, a concave mirror, or a convex mirror. And the mirror may comprise one or both of the following attributes: anti-fog and water repellant. Shapes of the mirror may be one of the following: circle, square, or rectangle. Still, in some embodiments, the shaving-mirror apparatus may further comprise a 90-degree ridge that extends along the bottom inside circumference of the open top of the receptacle, directly above the mirror. Or it may comprise a pocket extending along the bottom inside circumference of the open top of the receptacle for the purpose of inserting the bottom ridge of a shaving-can container. The receptacle of the shaving-mirror apparatus may be made from a variety of materials, such as polyurethane, silicone, or any type of polyethylene.

The manufacturing method comprises attaching a mirror to a receptacle, wherein the receptacle comprises an open top. The method may further comprise incorporating a horizontal slit into the receptacle in between the bottom and the open top.

Still other advantages, embodiments, and features of the subject disclosure will become readily apparent to those of ordinary skill in the art from the following description wherein there is shown and described a preferred embodiment of the present disclosure, simply by way of illustration of one of the best modes best suited to carry out the subject disclosure. As it will be realized, the present disclosure is capable of other different embodiments and its several details are capable of modifications in various obvious embodiments all without departing from, or limiting, the scope herein. Accordingly, the drawings and descriptions will be regarded as illustrative in nature and not as restrictive.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps that are illustrated. When the same numeral appears in different drawings, it refers to the same or like components or steps.

DETAILED DESCRIPTION OF THE ILLUSTRATIVE EMBODIMENTS

Before the present apparatuses, methods, and systems are disclosed and described, it is to be understood that the apparatuses, methods, and systems are not limited to specific methods, specific components, or to particular implementations. It is also to be understood that the terminology used herein is for the purpose of describing particular embodiments only and is not intended to be limiting. Various embodiments are described with reference to the drawings. In the following description, for purposes of explanation, numerous specific details are set forth in order to provide a thorough understanding of one or more embodiments. It may be evident, however, that the various embodiments may be practiced without these specific details. In other instances, well-known structures and devices are shown in block diagram form to facilitate describing these embodiments.

In accordance with the embodiments disclosed herein, the present disclosure is directed to a shaving-mirror apparatus that is compatible for placing onto the bottom of a shaving cream/gel container or the top of a shaving-gel squeeze bottle, and a manufacturing method for the shaving-mirror apparatus.

Figure 1:
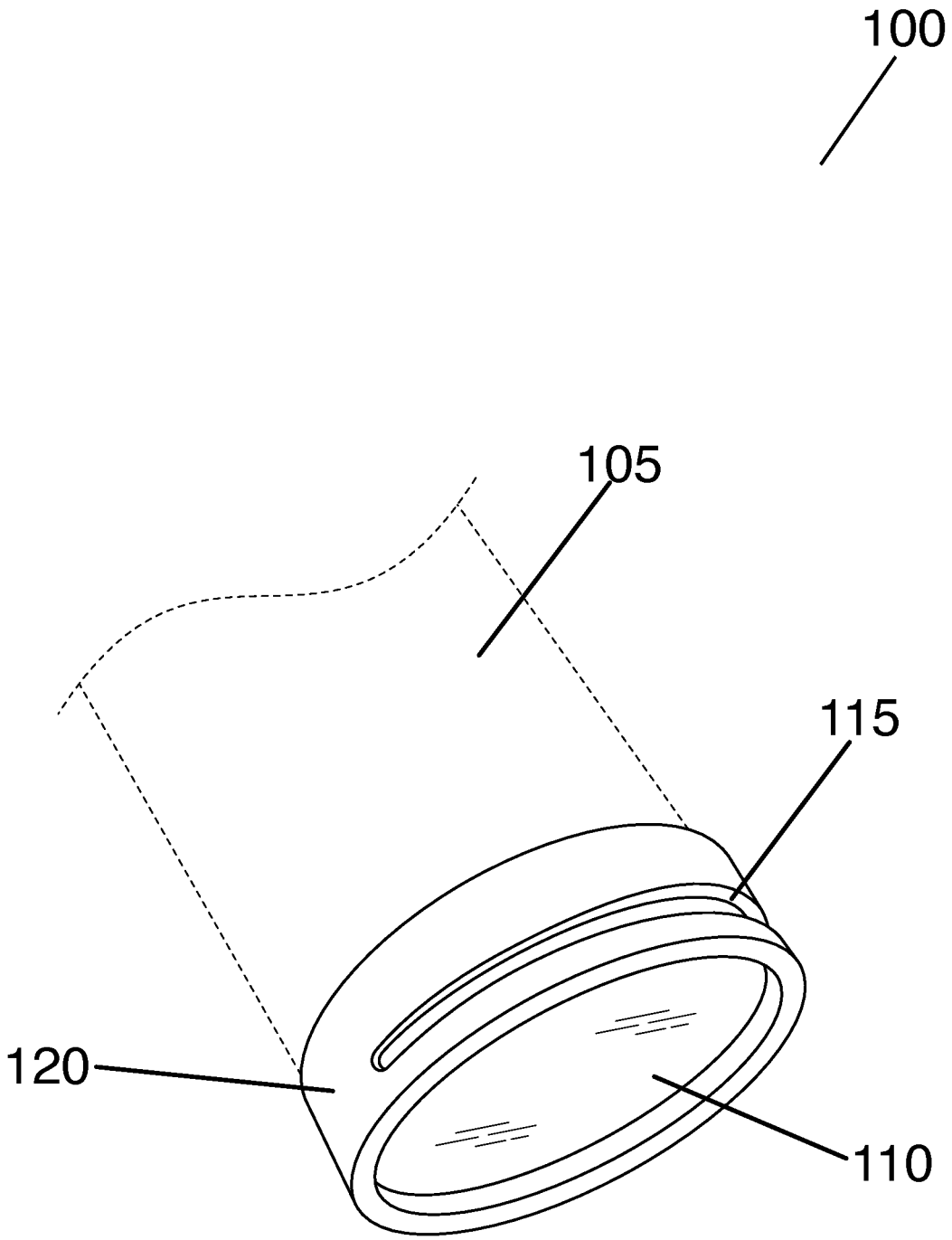
FIG. 1 generally illustrates an embodiment of a shaving-mirror apparatus.

FIG. 1 generally illustrates an embodiment of a shaving-mirror apparatus. As shown in FIG. 1, the shaving-mirror apparatus 100 comprises a receptacle, wherein the receptacle comprises a bottom and an open top. The open top may encompass the bottom of a container 105 such as a shaving-gel can (referenced herein throughout the application as "container" without reference to any one specific figure or embodiment). The bottom of the receptacle comprises a mirror 110. The receptacle may further comprise a horizontal slit 115 between the bottom and the open top.

In one embodiment, the apparatus comprises a wall 120, wherein the wall 120 comprises the slit 115. The wall 120 of the apparatus may further comprise a tapered edge at the top or it may comprise a square edge at the top. The shape of the apparatus is such that when it is placed onto the bottom of the container 105, the inside of the wall 120 completely encompasses the sides of the container 105 and the bottom of the container 105 rests upon the bottom inside of the apparatus 100. The apparatus 100 fits snuggly onto the container 105, wherein the apparatus 100 can be removed by an individual physically removing it from off the bottom of the container 105 in a slip-fit manner. And when placed on the bottom of the container 105, the apparatus 100 may provide additional support to the container 105, such that it can stand upright. Embodiments of the apparatus comprise various dimensions so they fit onto common container such as travel-size containers, wide-diameter containers, and slim-diameter containers.

The apparatus may be comprised of any material that enables the apparatus to retain its shape while being sufficiently flexible to fit onto the bottom of a container 105 or the top of a squeeze-bottle container. Examples of material include but are not limited to polyurethane, silicone, and types of polyethylene. The material of the apparatus can provide the additional benefit of preventing rust rings that form from an exposed wet container, and also reducing sliding of the container across a flat surface.

Figure 2:
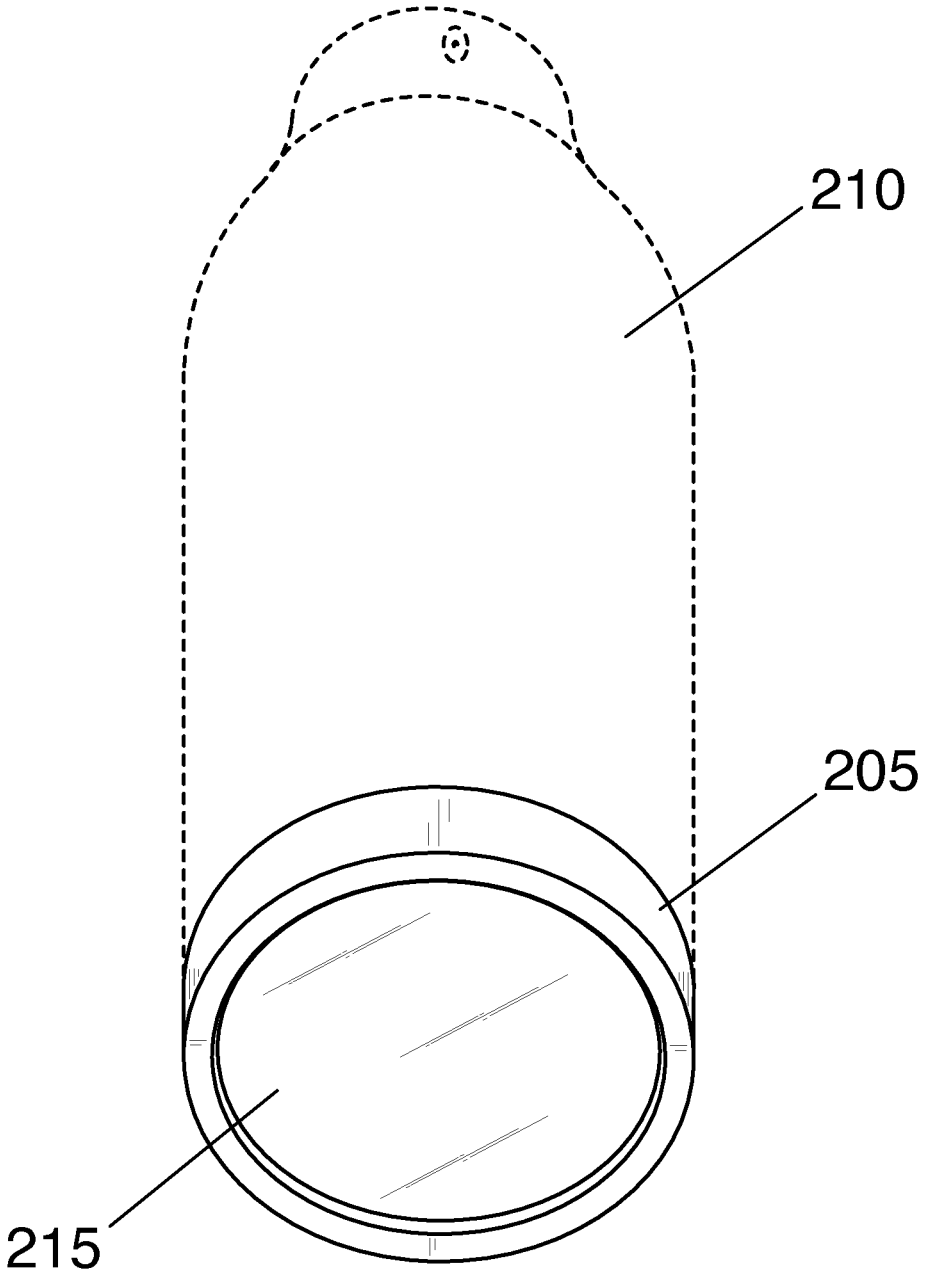
FIG. 2 generally illustrates an embodiment of a shaving-mirror apparatus on the bottom of a shaving-can container.

FIG. 2 generally illustrates an embodiment of a shaving-mirror apparatus on the bottom of a shaving-can container. As shown in FIG. 2, the inside of the wall 205 of the apparatus completely encompasses the sides of the container 210 with the bottom of the container 210 resting upon the inside of the apparatus and the apparatus fitting snuggly onto the container 210. The outside bottom of the apparatus comprises a mirror 215. The mirror 215 shown in FIG. 2 is a plane mirror, commonly referred to as a flat mirror. However, the apparatus may also comprise other embodiments of mirrors, such as convex mirrors. Embodiments of mirrors allow for varying benefits. For example, convex mirrors allow for a wider, more encompassing reflection, while flat mirrors allow for a more focused reflection.

The apparatus may use mirrors made of a variety of material, such as fiberglass mirrors, aluminum glass mirrors, low-aluminum glass mirrors, safety glass mirrors, silkscreen-printed glass mirrors, and silver glass mirrors. Mirrors used by the apparatus may comprise features such as moisture/water resistant and anti-fog. These features allow an individual to shave without the image in the mirror being obscured.

Figure 3:
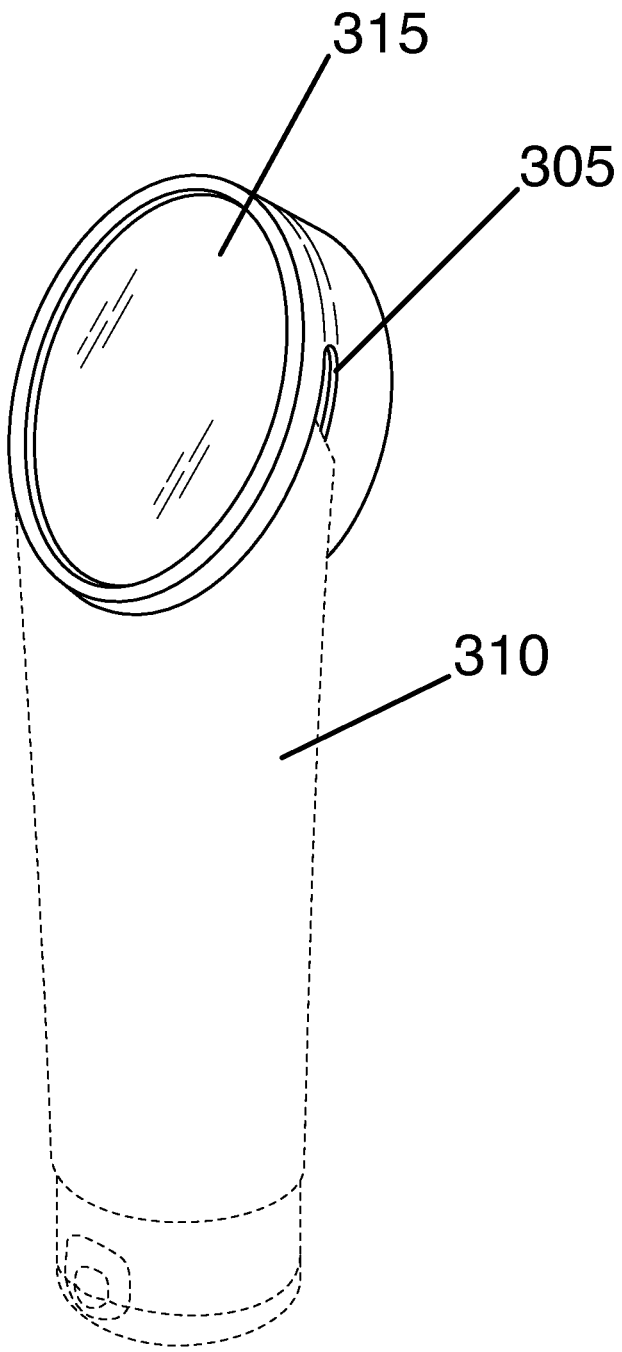
FIG. 3 generally illustrates an embodiment of a shaving-mirror apparatus on the top of a squeeze-bottle container.

FIG. 3 generally illustrates an embodiment of a shaving-mirror apparatus on the top of a squeeze-bottle container. As shown in FIG. 3, the slit 305 of the apparatus enables the apparatus to fit onto the top of a container 310. The apparatus enables a user to use the contents of the container 310 and shave with the mirror 315 while using the container 310 as a stand for the apparatus.

Figure 4:
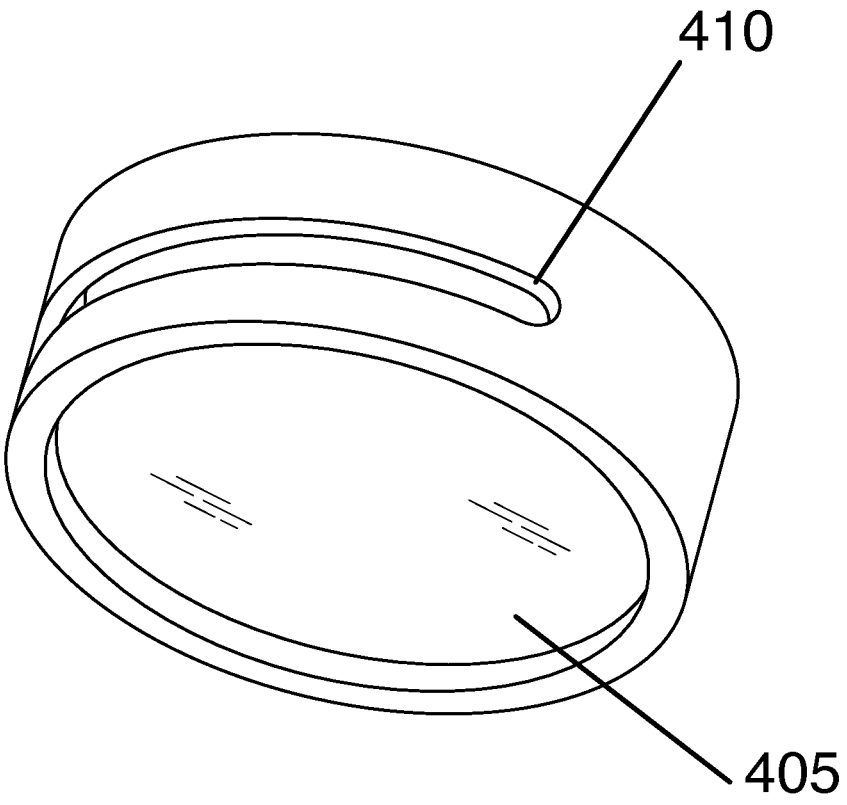
FIG. 4 generally illustrates an embodiment of a shaving-mirror apparatus.

FIG. 4 generally illustrates an embodiment of a shaving-mirror apparatus. As shown in FIG. 4, the bottom outside of the apparatus comprises a mirror 405 and the side of the apparatus comprises a slit 410. The mirror 405 is circular shaped. However, other embodiments may comprise a mirror with a different shape, such as a square, a star, a letter, a number, or an outline depicting the general shape of a desired image.

Figure 5:
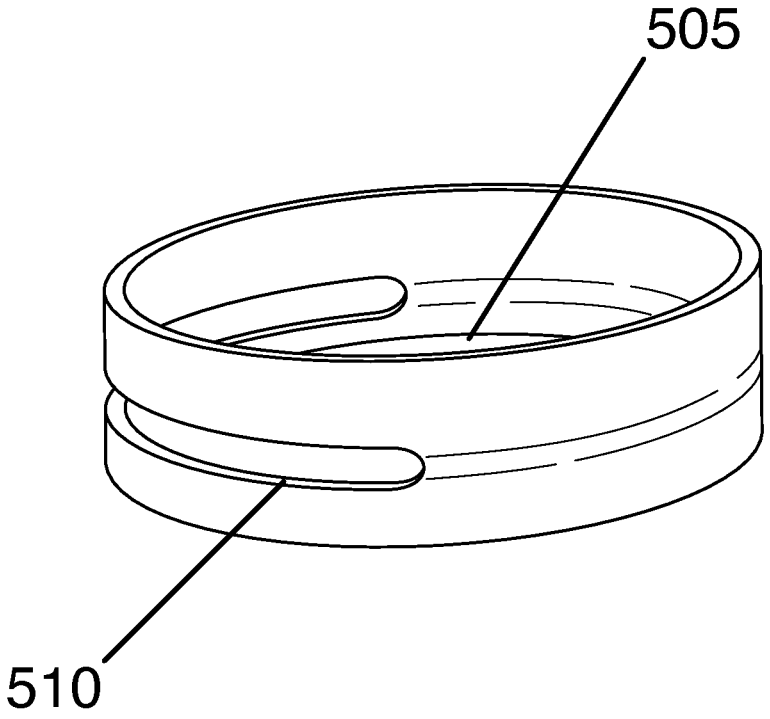
FIG. 5 generally illustrates an embodiment of a shaving-mirror apparatus.

FIG. 5 generally illustrates an embodiment of a shaving-mirror apparatus. As shown in FIG. 5, the apparatus comprises a receptacle, wherein the inside of the receptacle comprises a flat bottom 505 where a container may rest. And the apparatus may comprise a slit 510.

The apparatus may be compatible with various container sizes. For example, in one embodiment the inside of the apparatus may have an approximate diameter of 2.62 inches and the outside bottom may have an approximate diameter of 2.82 inches. In another embodiment, the inside of the apparatus may have an approximate diameter of 2.06 inches and the outside bottom may have an approximate diameter of 2.22 inches. Or the inside of the apparatus may have an approximate diameter of 1.32 inches and the outside bottom may have an approximate diameter of 1.47 inches. For each of these embodiments, the diameters for the inside and the outside bottom may vary, with the embodiment diameters varying by an approximate range of plus or minus 0.10-0.50 inches.

Figure 6:
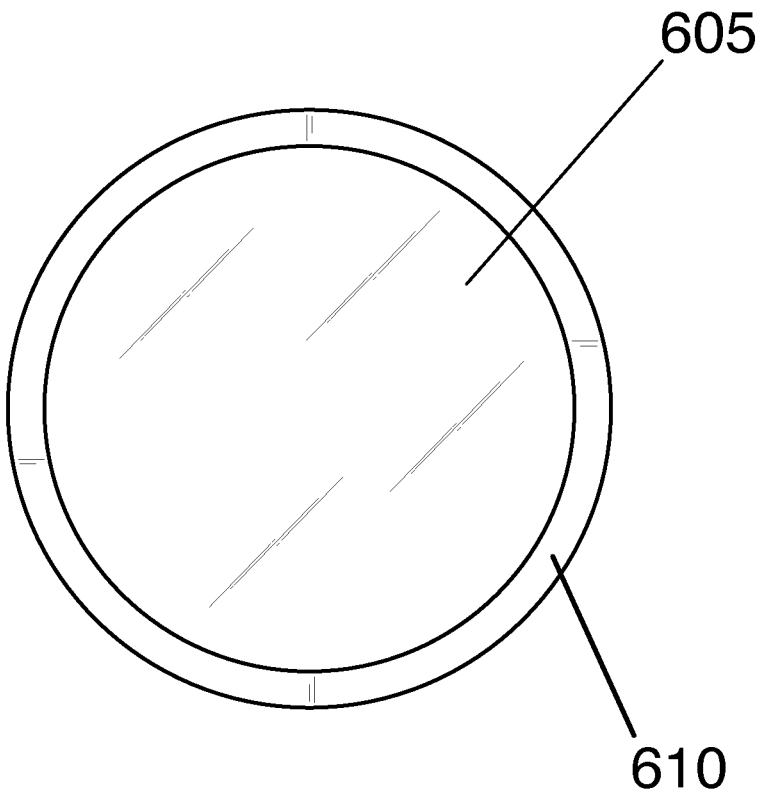
FIG. 6 generally illustrates an embodiment of a shaving-mirror apparatus.

FIG. 6 generally illustrates an embodiment of a shaving-mirror apparatus. As shown in FIG. 6, the apparatus comprises a bottom, wherein the bottom comprises a mirror 605 and a ridge 610 surrounding the mirror 605. The dimensions of the ridge 610 may vary based on the container with which it is compatible. For example, in some embodiments the ridge 610 may have a width of 0.20 inches, 0.16 inches, or 0.15 inches. Still, the ridge 610 may vary by a range of 0.10-0.35 inches.

Figure 7:
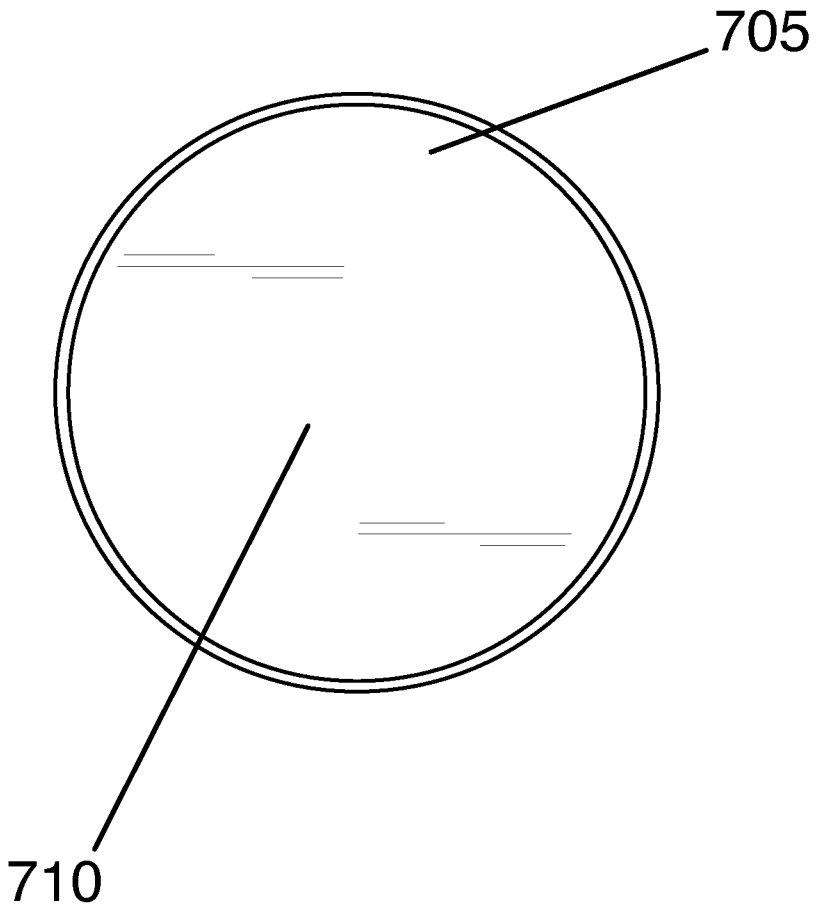
FIG. 7 generally illustrates an embodiment of a shaving-mirror apparatus.

FIG. 7 generally illustrates an embodiment of a shaving-mirror apparatus. As shown in FIG. 7, the apparatus comprises an open top 705, allowing for space into which a container may be inserted. The inside bottom of the apparatus may comprise a layer of material 710, such that the layer 710 prevents contact between the container and the mirror.

Figure 8:
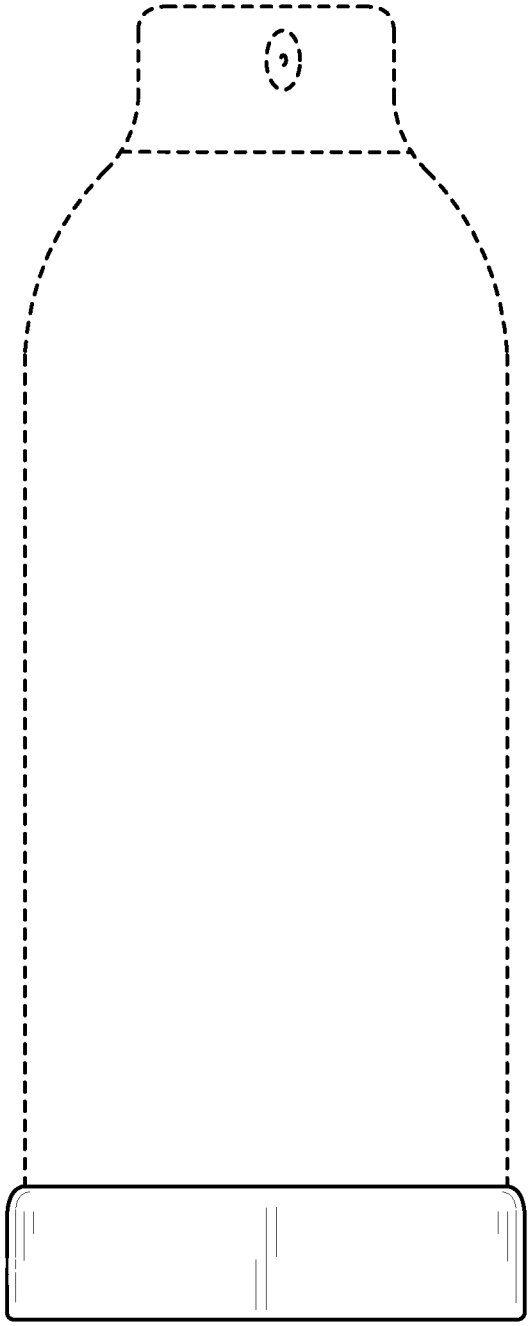
FIG. 8 generally illustrates an embodiment of a shaving-mirror apparatus positioned on the bottom of a shaving-can container.

FIG. 8 generally illustrates an embodiment of a shaving-mirror apparatus positioned on the bottom of a shaving-can container.

Figure 9:
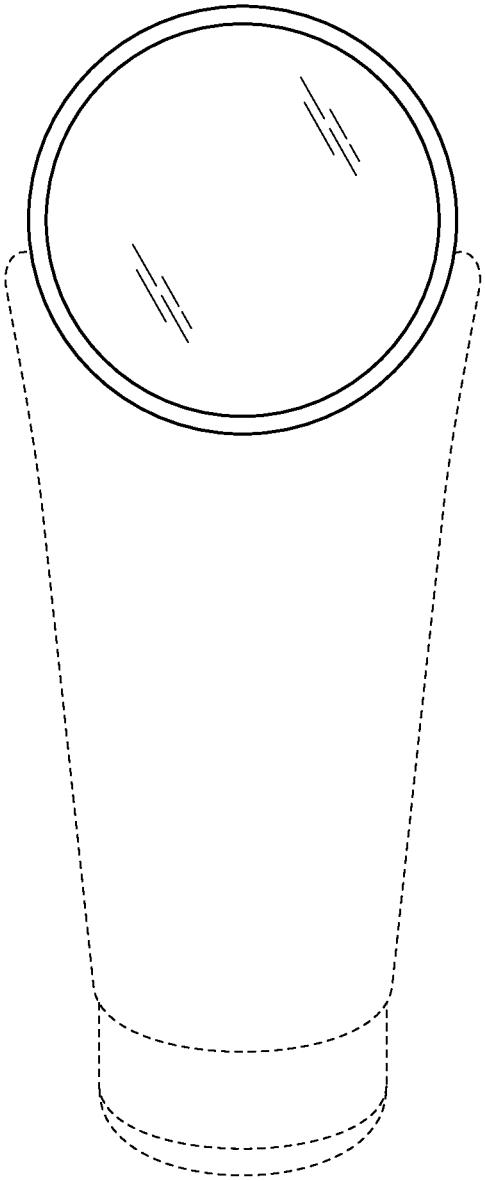
FIGS. 9-11 generally illustrate an embodiment of a shaving-mirror apparatus positioned on the top of a squeeze-bottle container.
Figure 10:
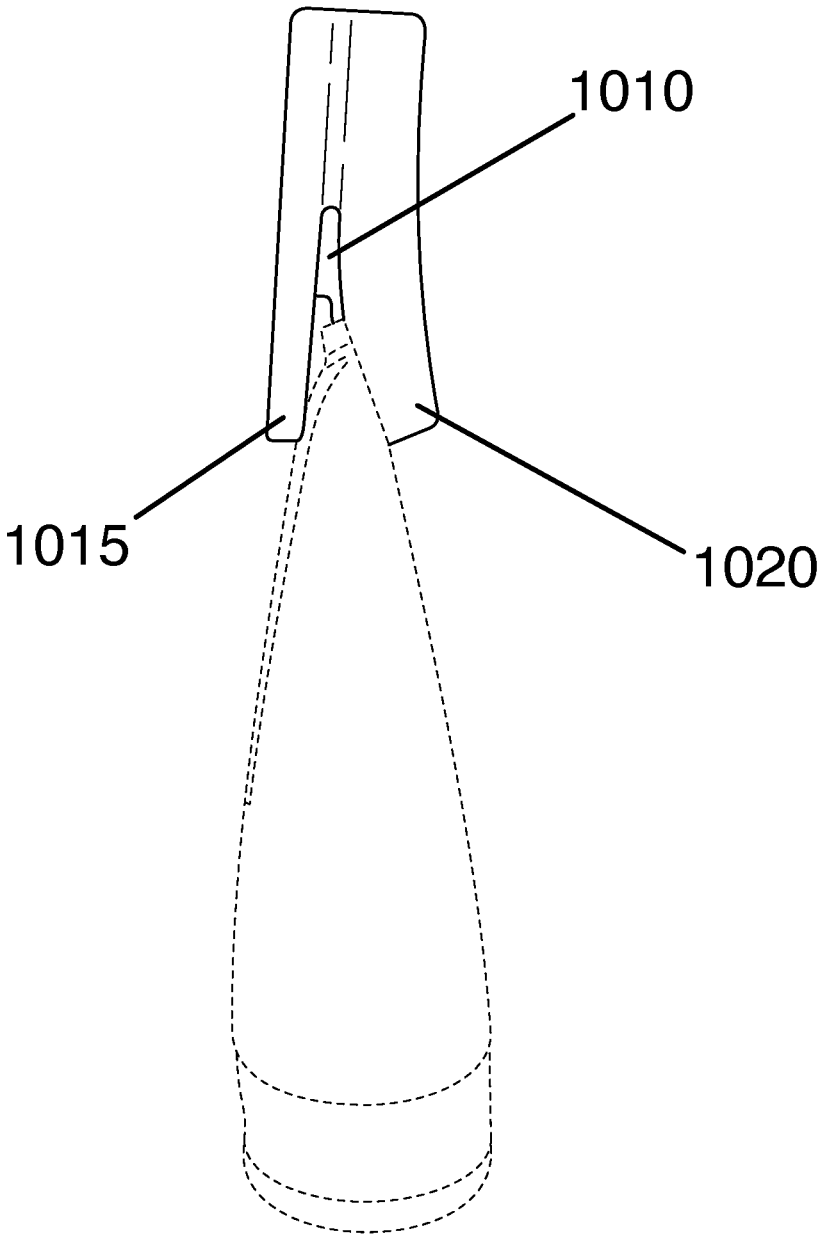
Figure 11:
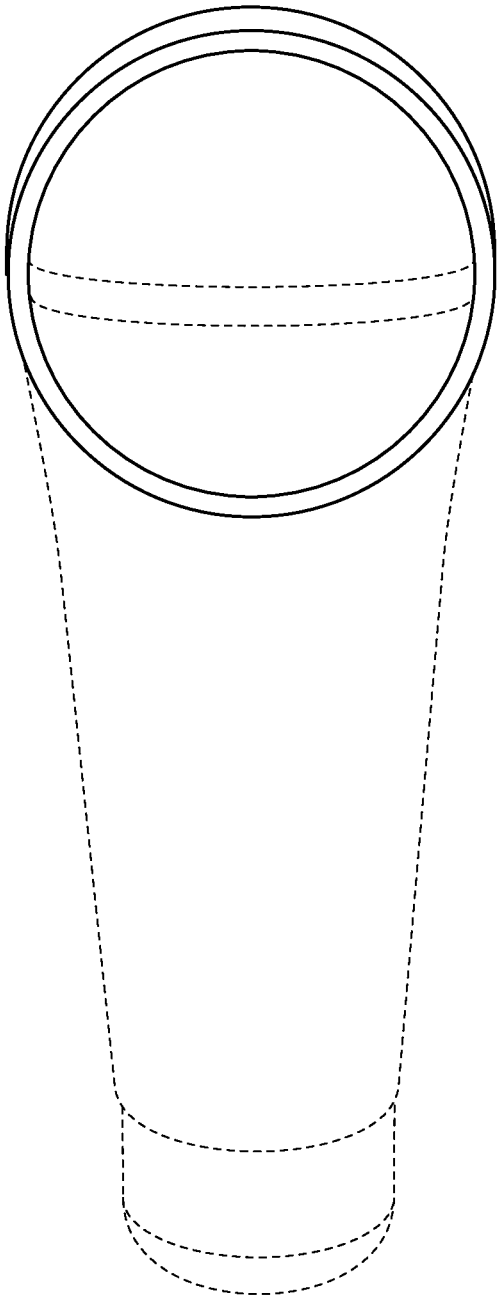

FIGS. 9-11 generally illustrate an embodiment of a shaving-mirror apparatus positioned on the top of a squeeze-bottle container. As shown in FIG. 10, the top of a squeeze-bottle container may be inserted into the slit 1010 of the apparatus such that the apparatus rests on the container. As shown in FIGS. 10 and 11, once the apparatus is resting on top of the container, a portion of the apparatus may rest on one side of the container with another portion of the apparatus resting on the other side of the container. As shown in FIG. 10, once the apparatus is resting on the container, the front side 1015 of the apparatus rests on the front of the container and the back side 1020 of the apparatus rests on the back of the container.

Figure 12:
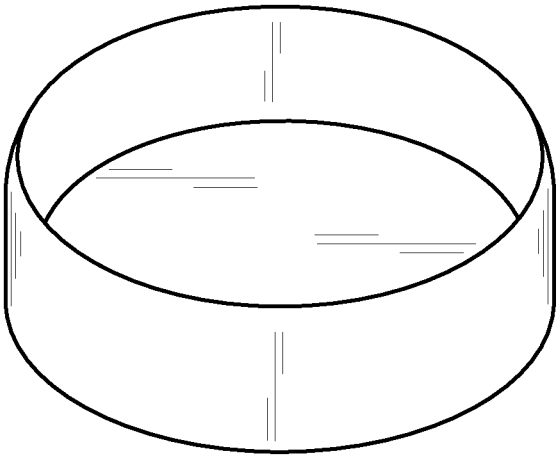
FIG. 12 generally illustrates an embodiment a shaving-mirror apparatus.

FIG. 12 generally illustrates an embodiment a shaving-mirror apparatus. As shown in FIG. 12, the apparatus may comprise an open top. The bottom inside of the apparatus may serve as a protective layer over the backside of the mirror, upon which the bottom of a container can rest. As shown in FIG. 12, the apparatus may not be required to comprise a slit.

Figure 13:
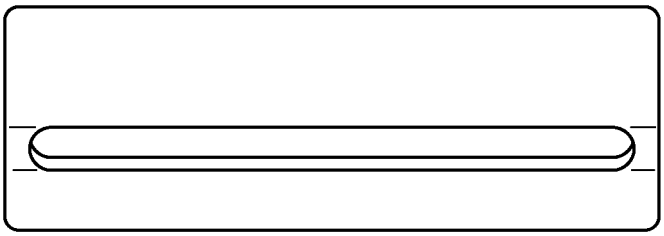
FIG. 13 generally illustrates an embodiment of a side view of a shaving-mirror apparatus with a horizontal slit.

FIG. 13 generally illustrates an embodiment of a side view of a shaving-mirror apparatus with a horizontal slit. The dimensions of the slit may vary in accordance with the dimension of the apparatus so as to be compatible with various container sizes—both with can and squeeze-bottle containers. For example, the length of the slit may have a length that spans slightly less than half the circumference of the apparatus. Or in another embodiment, the slit may have a length slightly longer than half the circumference of the apparatus.

Figure 14:
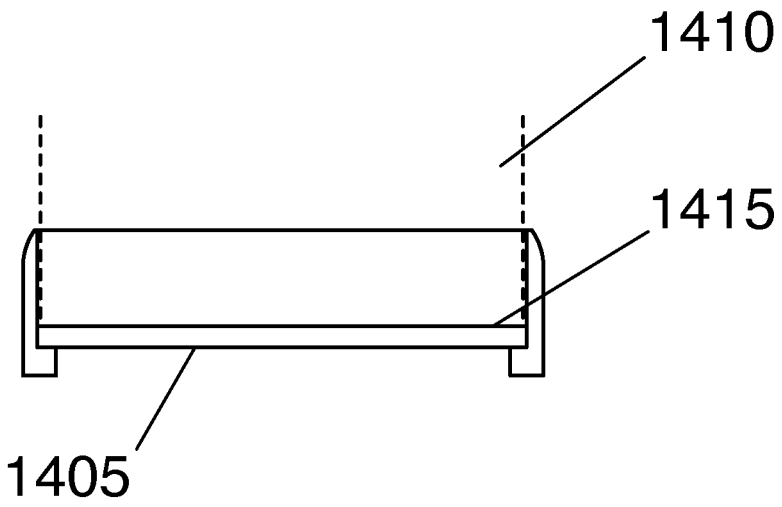
FIG. 14 generally illustrates an embodiment of a cross-sectional view of a shaving-mirror apparatus.

FIG. 14 generally illustrates an embodiment of a cross-sectional view of a shaving-mirror apparatus. As shown in FIG. 14, the apparatus may comprise a mirror 1405 and an open top, wherein a container 1410 may rest on the bottom inside 1415 of the open top. As shown in FIG. 14, the apparatus may not necessarily comprise a protective layer above the mirror 1405.

Figure 15:
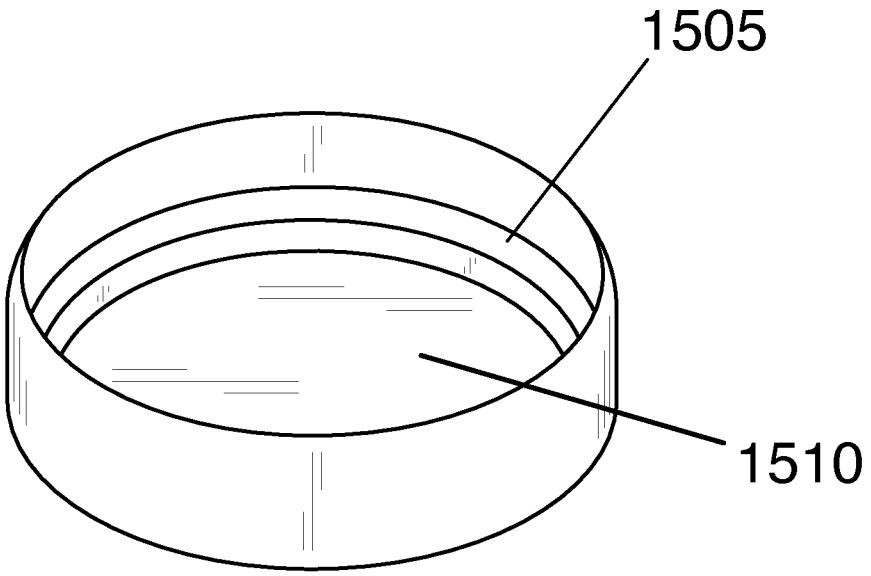
FIG. 15 generally illustrates an embodiment of a perspective view of a shaving-mirror apparatus with a ridge/lip.

FIG. 15 generally illustrates an embodiment of a perspective view of a shaving-mirror apparatus with a ridge/lip. As shown in FIG. 15, the apparatus may comprise a lip/ridge 1505 upon which a container may rest, allowing for space between the container and the inside bottom 1510 of the apparatus.

Figure 16:
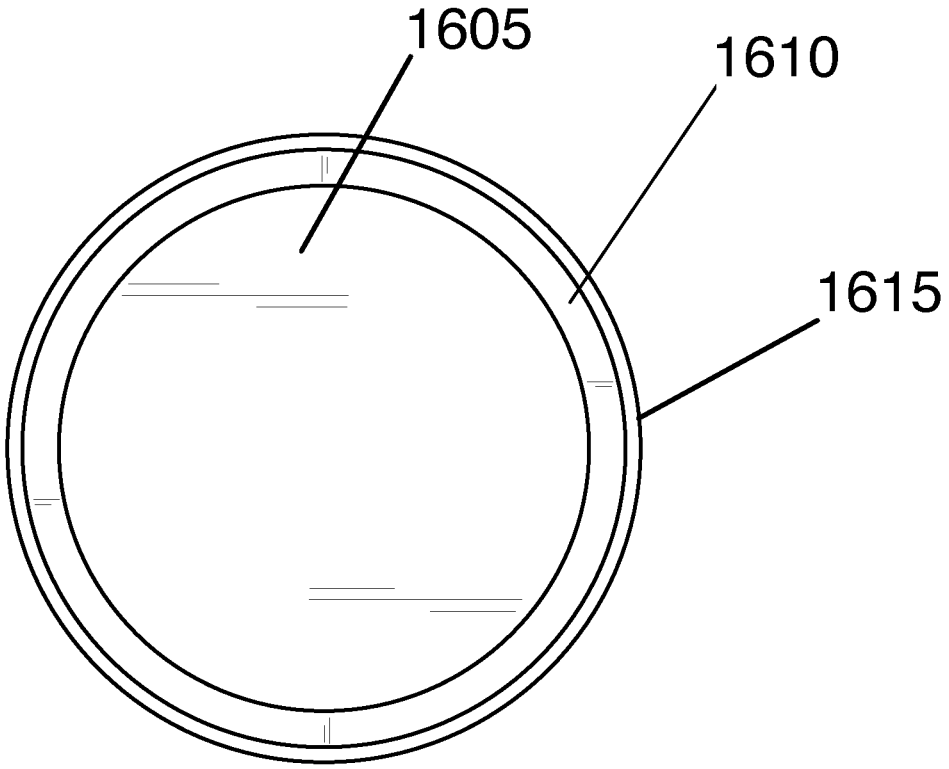
FIG. 16 generally illustrates an embodiment of the inside view of a shaving-mirror apparatus with a ridge/lip.

FIG. 16 generally illustrates an embodiment of the inside view of a shaving-mirror apparatus with a ridge/lip. As shown in FIG. 16, the open top of an apparatus may comprise a bottom inside 1605, a ridge/lip 1610, and an outside wall 1615.

Figure 17:
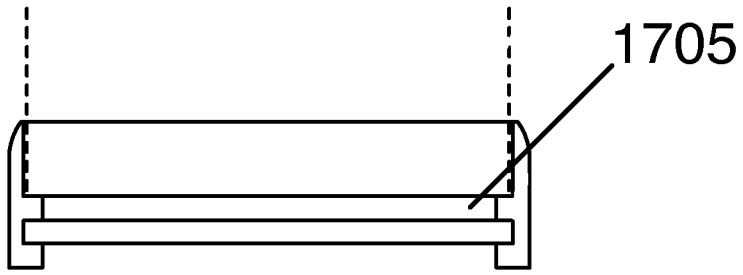
FIG. 17 generally illustrates an embodiment of a cross-sectional view of a shaving-mirror apparatus with a ridge/lip.

FIG. 17 generally illustrates an embodiment of a cross-sectional view of a shaving-mirror apparatus with a ridge/lip. As shown in FIG. 17, the apparatus may comprise a ridge/lip 1705 above the mirror.

Figure 18:
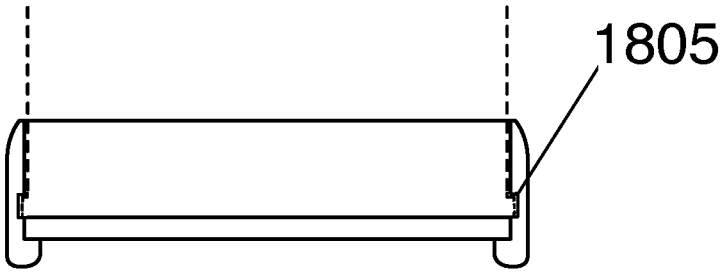
FIG. 18 generally illustrates an embodiment of a cross-sectional view of a shaving-mirror apparatus.

FIG. 18 generally illustrates an embodiment of a cross-sectional view of a shaving-mirror apparatus. As shown in FIG. 18, the apparatus may comprise a pocket 1805 into which the outside ridge of the bottom of a can container may be inserted.

Figure 19:
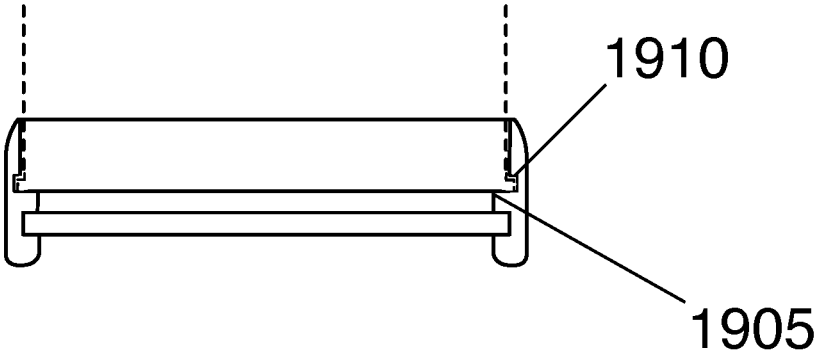
FIG. 19 generally illustrates an embodiment of a cross-sectional view of a shaving-mirror apparatus with a ridge/lip and inside pocket.

FIG. 19 generally illustrates an embodiment of a cross-sectional view of a shaving-mirror apparatus with a ridge/lip and inside pocket. As shown in FIG. 19, the apparatus may comprise one lip/ridge 1905 upon which the bottom of a container may rest and an inside pocket 1910 into which the outside ridge of the bottom of a can container may be inserted.

Figure 20:
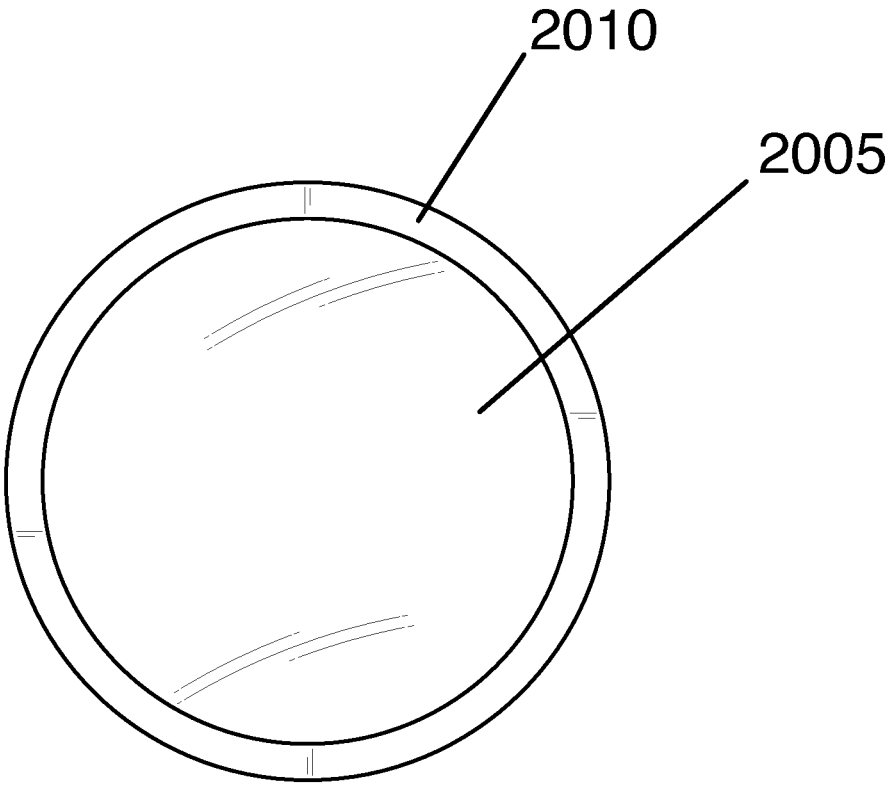
FIG. 20 generally illustrates an embodiment of a shaving-mirror apparatus with a convex mirror.

FIG. 20 generally illustrates an embodiment of a shaving-mirror apparatus with a convex mirror. As shown in FIG. 20 the apparatus may comprise a convex mirror 2005, wherein the convex mirror 2005 is surrounded by an outside wall 2010, wherein the outside wall 2010 may provide support to the container when placed on the bottom of the container.

Figure 21:
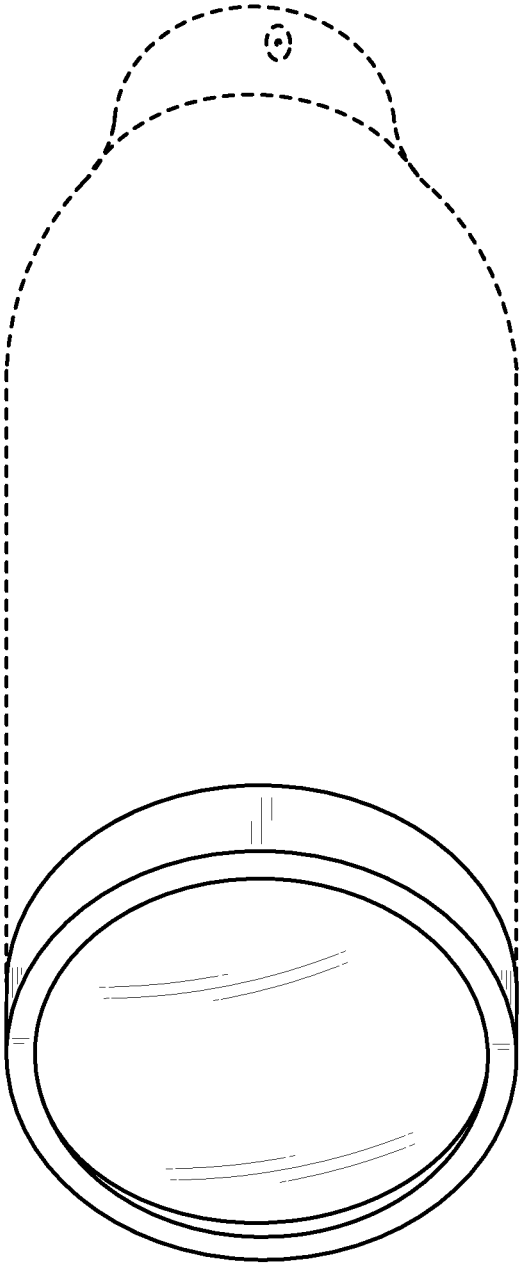
FIG. 21 generally illustrates an embodiment of a shaving-mirror apparatus with a convex mirror positioned on the bottom of a shaving-can container.

FIG. 21 generally illustrates an embodiment of a shaving-mirror apparatus with a convex mirror positioned on the bottom of a shaving-can container.

Figure 22:
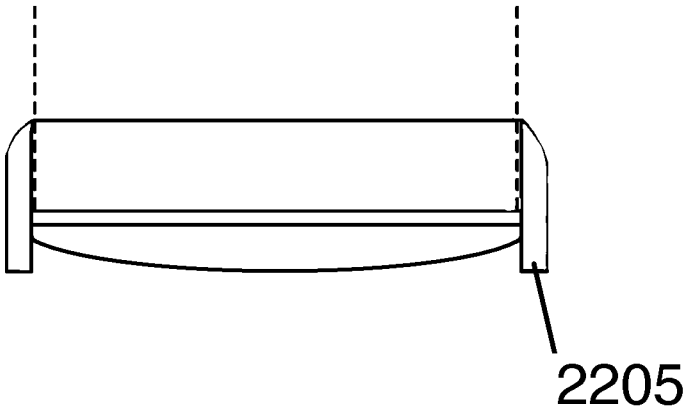
FIGS. 22 and 23 generally illustrate embodiments of a cross-sectional view of a shaving-mirror apparatus with a convex mirror, wherein the positioning of the convex mirror within the side wall varies.
Figure 23:
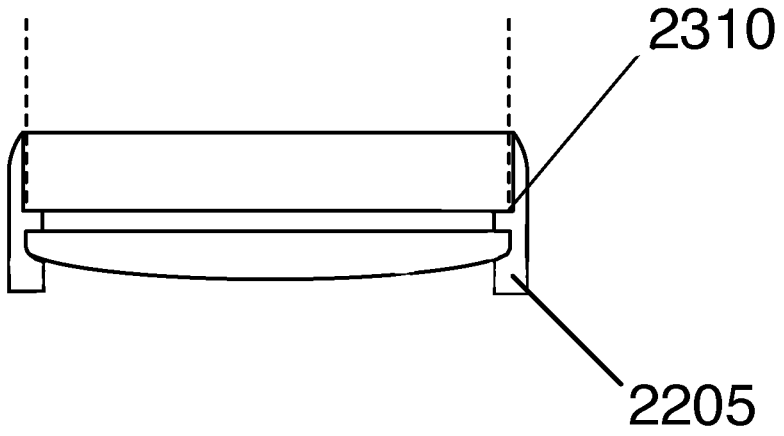

FIGS. 22 and 23 generally illustrate embodiments of a cross-sectional view of a shaving-mirror apparatus with a convex mirror, wherein the positioning of the convex mirror within the side wall 2205 varies. Embodiments may comprise or lack a ridge/lip 2310.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order; it is in no way intended that an order be inferred, in any respect. This holds for any possible non-express basis for interpretation, including matters of logic with respect to arrangement of steps or operational flow; plain meaning derived from grammatical organization or punctuation; the number or type of embodiments described in the specification.

What is claimed is:

1. A shaving-mirror apparatus to place onto a bottom of a shaving-cream container, comprising:

a receptacle, wherein the receptacle comprises a bottom, a side wall, a horizontal slit, and an open top;

wherein the bottom of the receptacle comprises a mirror;

wherein the horizontal slit is an opening in the side wall, wherein the horizontal slit is positioned between the bottom comprising the mirror and the open top;

wherein the open top is configured to engage with the bottom of the shaving-cream container.

2. The shaving-mirror apparatus of claim 1, wherein the mirror comprises one of the following: a flat mirror, a concave mirror, or a convex mirror.

3. The shaving-mirror apparatus of claim 1, wherein the mirror comprises one or both of the following attributes: anti-fog and water repellant.

4. The shaving-mirror apparatus of claim 1, wherein the shape of the mirror is one of the following: circle, square, or rectangle.

5. The shaving-mirror apparatus of claim 1, wherein the receptacle is made from one of the following materials: polyurethane, silicone, or a type of polyethylene.

6. A method, comprising:

attaching a mirror to a bottom portion of a receptacle;

wherein the receptacle comprises a flexible material and wherein the receptable comprises an open top and an outer side;

wherein the outer side connects the bottom portion and the open top;

wherein the outer side of the receptacle comprises a horizontal opening positioned above the bottom portion and below the open top;

wherein the open top is configured to engage with a bottom of a shaving-cream container.

7. The method of claim 6, wherein the mirror comprises one of the following: a flat mirror, a concave mirror, or a convex mirror.

8. The method of claim 6, wherein the mirror comprises one or both of the following attributes: anti-fog and water repellant.

9. The method of claim 6, wherein the shape of the mirror is one of the following: circle, square, or rectangle.

10. The method of claim 6, wherein the receptacle is made from one of the following materials: polyurethane, silicone, or a type of polyethylene.

* * * * *